US006378270B1

(12) United States Patent
Araki et al.

(10) Patent No.: US 6,378,270 B1
(45) Date of Patent: Apr. 30, 2002

(54) POWDER GRAIN MATERIAL CONTROL UNIT AND POWDER GRAIN MATERIAL FILLING UNIT HAVING THIS UNIT

(75) Inventors: Shigeru Araki, Tokyo; Hajime Morimoto, Fukuoka-ken, both of (JP)

(73) Assignee: Kabushiki Kaisha Tekunika, Tokyo (JP)

( * ) Notice: Subject to any disclaimer, the term of this patent is extended or adjusted under 35 U.S.C. 154(b) by 0 days.

(21) Appl. No.: 09/511,040

(22) Filed: Feb. 23, 2000

(30) Foreign Application Priority Data

Feb. 23, 1999 (JP) ..... 11-045462

(51) Int. Cl.[7] ..... B65B 1/06
(52) U.S. Cl. ..... 53/284.7; 241/260.1
(58) Field of Search ..... 53/121, 284.7, 53/551, 552, 570; 141/4, 5, 6, 8, 10, 39, 40, 51, 286; 241/79.2, 260.1

(56) References Cited

U.S. PATENT DOCUMENTS 4,185,669 A * 1/1980 Jevakohoff ..... 141/59
4,381,545 A * 4/1983 Biddle, III et al. ..... 364/479
5,316,056 A * 5/1994 Stott ..... 141/68
5,615,830 A * 4/1997 Matsunaga et al. ..... 239/8

* cited by examiner

*Primary Examiner*—Rinaldi I. Rada
*Assistant Examiner*—Nathaniel Chukwurah
(74) *Attorney, Agent, or Firm*—Duane Morris LLP

(57) ABSTRACT

A powder grain material control unit has a cylindrically formed filter and a negative pressure chamber formed at the outer periphery of the filter. As powder grain material is discharged from an outflow portion of the powder grain material control unit, the inner peripheral portion side of the cylindrical filter is negatively pressurized so as to absorb and maintain the powder grain material of this part on the cylindrical filter side and so as to stop the discharge of the powder grain material flowing on the inner peripheral portion side of the cylindrical filter. The control unit may be used in combination with a powder grain filling unit that includes material carrying means which may be an auger having a spiral blade provided with a central axis of rotation.

18 Claims, 10 Drawing Sheets

POWDER GRAIN MATERIAL CONTROL UNIT AND POWDER GRAIN MATERIAL FILLING UNIT HAVING THIS UNIT

BACKGROUND OF THE INVENTION

This invention relates to a powder grain material control unit for stopping the discharge of the powder grain material and a powder grain material filling unit providing this unit with the powder grain material outflow portion for filling with powder grain material.

In medicines and foodstuff, powder or grain (called "powder grain material" in a general term) is existent in the past. Generally, in many cases, the powder grain material is dealt with by packing in a bag or a container.

A powder grain material filling unit as shown in FIG. 10 is one instance of the unit for filling a bag with the powder grain material.

This powder grain material filling unit 20 has a hopper 22 in the shape of a cone provided with a support frame 21 for storing the powder grain material, a drop guide cylinder 23 provided with the lower portion of the hopper 22 for guiding the drop of the powder grain material, a rotatable auger (another name is a screw) 25 connected with a driving motor 24 positioning on the upper portion of the hopper 22 and stored in the drop guide cylinder, and a powder grain material control unit 26 provided with the drop guide cylinder 23 for stopping the discharge of the powder grain material from the drop guide cylinder 23.

The powder grain material control unit 26 has a pair of plungers 27, 27 provided with the drop guide cylinder 23, and a switch valve 28 in the shape of a cone made of resin, for opening and closing a powder grain material outflow portion 23*a* of the drop guide cylinder 23, going up and down by these plungers 27.

When the driving motor 24 is started to operate so as to rotate the auger 25 after the powder grain material is entered in the hopper 22, the powder grain material in the hopper flows in the drop guide cylinder 23. But, the drop of the powder grain material is adjusted so as to transfer to the lower hand by the rotating auger 25.

When the plungers 27 of the powder grain material control unit 26 are not operated, the switch valve 28 opens the powder grain material outflow portion 23*a* of the drop guide cylinder 23, being away from the lower portion of the drop guide cylinder 23. The powder grain material P drops in a transparent vinyl bag 29, for instance, receiving the lower portion of the drop guide cylinder 23.

When a predetermined quantity of the powder grain material drops in a vinyl bag, the plungers 27 are operated so as to pick up the switch valve 28. The switch valve 28 adheres to the powder grain material outflow portion 23*a* of the drop guide cylinder 23 and closes the powder grain material outflow portion 23*a* so as to stop the discharge of the powder grain material.

Lastly, a pair of bag closing pieces 30 (seen as one in FIG. 10 since they overlap each other) approach each other from the front and the back of the vinyl bag 29 (the direction of the inside and the outside of the paper) so as to hold the upper portion of the vinyl bag 29. A pair of the bag closing pieces 30 are heated and the vinyl bag 29 is sealed by melting and adhering the vinyl to each other.

On this occasion, the vinyl bag is formed by closing the vinyl cylinder supplied enclosing the powder grain material control unit with the bag closing pieces 30.

But, the following problems are existent since the conventional powder grain material control unit 26 stops the discharge of the powder grain material by adhering the switch valve 28 in the shape of a cone to the powder grain material outflow portion 23*a*.

That is, the powder grain material is held between the switch valve 28 and the powder grain material outflow portion 23*a*, then the space generates, then, the discharge of the powder grain material can not be completely stopped since the powder grain material continues to slightly flow from the space.

If it is used for a long time, wear and tear generate at the portion of the switch valve made of resin contacting the powder grain material outflow portion 23*a*. Then, the powder grain material outflow portion 23*a* can not be certainly sealed by the switch valve 28, so it is necessary to change the switch valve.

The sound of operating a pair of plungers 27 is the origin of noise.

The switch valve 28 and the powder grain material outflow portion 23*a* vibrate by the vibration of a pair of plungers 27 at the time of operating, and the portion contacting the switch valve 28 and the powder grain material outflow portion 23*a* with each other is shifted from each other so as to generate a space. Then, the powder grain material may drop from the space.

It is difficult to make the switch valve 28 the smaller since it is provided with a switch valve support plate 31 interlocking the plungers 27.

Besides, the powder grain material filling unit having the above-mentioned conventional powder grain material control unit which can not certainly stop the discharge of the powder grain material has the following problems.

The quantity of filling the powder grain material varies widely and the accuracy of filling is bad.

It is impossible to make the minimum size of a bag small since the switch valve support plate 31 interlocking the plungers 27, supporting the switch valve 28 is entered in the bag.

Since the powder grain material discharged from the powder grain material outflow portion 23*a* drops, hitting the switch valve 28 and the switch valve support plate 31 crossing the lower hand of the powder grain material outflow portion 23*a*, it is blown up in the bag in case of a transparent bag, so the degree of transparency in the bag 29 is reduced. Then, it is difficult to confirm the filling state in the bag 29 from the outside.

In case of a vinyl bag, the powder grain material being blown up in the vinyl bag 29 also adheres to the upper portion of the inside of the vinyl bag 29. When the vinyl bag 29 is sealed by melting and adhering the upper portion of the vinyl bag 29 with a pair of bag closing pieces 30 heated, it is hard to adhere vinyl to each other. Then, it is difficult to completely seal the vinyl bag 29.

For instance, the measuring accuracy of the weight measuring means for measuring the weight of the powder grain material is reduced by the vibration of a pair of plungers 27 at the time of operating, so it is difficult to improve the filling accuracy.

Then, there is the unit having a butterfly valve (not shown) for opening and closing the powder grain material outflow portion by a rotatable switch valve as the powder grain material control unit wherein vibration is few.

In this powder grain material control unit, the switch valve rotates and vibration is few, but the powder grain material is held between the switch valve and the inner wall of the powder grain material outflow portion. Then, a space generates, and the powder grain material may drop out from the space.

Besides, when the powder grain material is held between the switch valve and the inner wall of the powder grain material outflow portion, the switch valve may not be opened thereafter.

Anyway, the conventional powder grain material control unit may not certainly and speedily stop the discharge of the powder grain material since the discharge of the powder grain material is stopped with mechanical operation by adhering the parts to each other and then, a space generates between the parts for stopping the discharge of the powder grain material.

SUMMARY OF THE INVENTION

The object of the present invention is to provide the powder grain material control unit for certainly and speedily stopping the discharge of the powder grain material with no mechanical operation by adhering the parts to each other.

Besides, the object of the present invention is to provide the powder grain material control unit having few necessity of changing the parts by making it such a structure that no wear and tear generates on the parts after using for a long time.

Besides, the object of the present invention is to provide the powder grain material control unit having few vibration and noise by making it such a structure that there is few vibration.

Besides, the object of the present invention is to provide the small-sized powder grain material control unit with no member crossing the lower hand of the powder grain material outflow portion.

Besides, the object of the present invention is to provide the powder grain material control unit having no non-operable state by making it such a structure that the powder grain material is not held.

Besides, the object of the present invention is to provide the powder grain material filling unit wherein filling quantity does not widely vary and filling accuracy is high having the above-mentioned powder grain material control unit for certainly stopping the discharge of the powder grain material.

Besides, the object of the present invention is to provide the powder grain material filling unit wherein the minimum size of a bag can be smaller, having the above-mentioned small-sized powder grain material control unit.

Besides, the object of the present invention is to provide the powder grain material filling unit wherein the powder grain material is not hard blown up in the bag and the filling state in the bag is easily confirmed from the outside in case of a transparent bag, having the above-mentioned powder grain material control unit having no parts on which the powder grain material discharged from the powder grain material outflow portion hits during dropping.

Besides, the object of the present invention is to provide the powder grain material filling unit wherein the powder grain material is not hard blown up in the vinyl bag in case of a vinyl bag, then the degree of melting and adhering the vinyl to each other is increased so as to completely seal the vinyl bag, having the above-mentioned powder grain material control unit having no parts on which the powder grain material discharged from the powder grain material outflow portion hits during dropping.

Besides, the object of the present invention is to provide the powder grain material filling unit wherein the measuring accuracy of the weight measuring means for measuring the weight of the powder grain material is improved, for instance, so as to improve the filling accuracy, having the above-mentioned powder grain material control unit wherein vibration is few.

The powder grain material control unit of the present invention has a cylindrical filter cylindrically formed and a negative pressure chamber formed at the outer periphery of the cylindrical filter, having such a characteristic that the air in the negative pressure chamber is absorbed, and the inner peripheral portion side of the cylindrical filter is made more negative pressure than a predetermined so as to stop the discharge of the powder grain material flowing in the inner peripheral portion of the cylindrical filter by attaching the cylindrical filter and the negative pressure chamber to the powder grain material outflow portion from which the powder grain material discharges.

The powder grain material control unit of the above-mentioned present invention is used by attaching to the powder grain material outflow portion. The powder grain material goes out from the powder grain material outflow portion and is discharged passing through the inside of the inner peripheral portion of the cylindrical filter.

In order to stop the discharge of the powder grain material, the air in the negative pressure chamber is absorbed so as to make the inside of the inner peripheral portion of the cylindrical filter negative pressure than a predetermined. The powder grain material is absorbed on the inner wall of the cylindrical filter so as to make a secondary filter layer by the powder grain material. The air of the powder grain material in the inner peripheral portion of the cylindrical filter passes through the secondary filter layer by the powder grain material and the cylindrical filter so as to absorbed in, thereby the powder grain material is absorbed and maintained on the cylindrical filter side.

The secondary filter layer is the fixed layer of the powder grain material made at the inner periphery of the cylindrical filter, and the quantity of its airflow, that is, the powder of absorbing and maintaining the powder grain material can be adjustable by the quantity of absorbing air in the negative pressure chamber. Besides, the cylindrical filter is not directly contacted with the powder grain material inside the secondary filter layer by the secondary filter layer itself, and blocking does not generate as long as the airflow of the secondary filter layer lasts. Accordingly, the secondary filter layer is not the layer made by the blocking of the filter cylinder, but it prevents the fine grain of the powder grain material inside the secondary filter layer from reaching the filter cylinder so as to prevent the blocking of the filter cylinder and to improve the efficiency of absorbing air.

With the absorption of air, the powder grain material inside the inner peripheral portion of the cylindrical filter is blocked at the inner hand of the cylindrical filter in a hardened state and high density state so as to stop the discharge.

That is, the powder grain material can stop the discharge and the powder grain material itself serves as a valve for stopping the flow of the powder grain material so as to stop the discharge of the powder grain material thereafter.

As mentioned above, the powder grain material control unit of the above-mentioned invention does not stop the discharge of the powder grain material by adhering the parts to each other, but stops the discharge of the powder grain material by making the inside of the cylindrical filter negative pressure, and besides, it makes the powder grain material, to which the discharge is stopped, do the role of a valve for stopping further discharge of the powder grain material so as to stop the discharge of the powder grain material with no mechanical operation, correctly and speedily.

In the powder grain material control unit of the present invention, the powder grain material outflow portion faces downwardly, the inner peripheral portion side of the cylindrical filter is made negative pressure rather than the predetermined so as to stop the flow of the powder grain material flowing in the inner peripheral portion of the cylindrical filter, and it is made pressure which does not exceed the predetermined negative pressure so as to discharge the powder grain material in the cylindrical filter.

The powder grain material control unit of the present invention can stop the discharge of the powder grain material flowing in the inner peripheral portion of the cylindrical filter when the inner peripheral portion side of the cylindrical filter is made negative pressure rather than the predetermined. And, the powder grain material in the cylindrical filter is discharged since the absorption with respect to the cylindrical filter is released when the inner peripheral portion side of the cylindrical filter is made the pressure which does not exceed the predetermined negative pressure.

In the powder grain material control unit of the present invention, by providing the powder grain material carrying means for pushing out the powder grain in the guide cylinder which guides the powder grain material and making the top end of the guide cylinder the powder grain material outflow portion, the powder grain material control unit of the present invention discharges the powder grain material by the operation of the powder grain material carrying means and stops the discharge of the powder grain material by stopping the operation of the powder grain material carrying means in such a state that the inner peripheral portion side of the cylindrical filter is made the negative pressure rather than the predetermined.

The powder grain material control unit of the present invention is attached to the powder grain material outflow portion of the top end of the guide cylinder. The powder grain material is carried in the guide cylinder by the powder grain material carrying means and is entered in the cylindrical filter. On the other hand, the inner peripheral portion side of the cylindrical filter is made the negative pressure rather than the predetermined.

The powder grain material carried in the cylindrical filter is always maintained at the inner peripheral portion side of the cylindrical filter in a hardened and high density state.

When the operation of the powder grain material carrying means is stopped, the powder grain material is still maintained inside the cylindrical filter in blocking state by the negative pressure so as to stop the flow.

When the powder grain material carrying means is operated, the powder grain material is carried and discharged. When the powder grain material blocking in the cylindrical filter is discharged, new powder grain material is entered in the cylindrical filter so as to maintain in this filter.

Then, the powder grain material control unit of the above-mentioned invention discharges the powder grain material held by the cylindrical filter by the operation of the powder grain material carrying means.

In order to discharge the powder grain material, the absorption of air may be stopped so as to release the negative pressure of the inner peripheral portion side of the cylindrical filter and the absorption of air may be reopened just before stopping the discharge of the powder grain material so as to make the inner peripheral portion side of the cylindrical filter negative pressure. In this case, the change of the negative pressure helps the discharge of the powder grain material by the powder grain material carrying means.

The cylindrical filter of the powder grain material control unit of the present invention has the filter cylinder in the shape of cylinder, and the inside and the outside porous cylinders in the shape of a cylinder for respectively holding the inner periphery and the outer periphery of the filter cylinder through the gauze cylinders in the shape of a cylinder, and many air passage pores through which air passes are formed at the gauze cylinders and the inside and the outside porous cylinders.

The negative pressure chamber of the powder grain material control unit of the present invention is formed between the inner periphery of the casing which both ends of the cylindrical filter are fixed in a sealed state and the outer periphery of the cylindrical filter.

In the powder grain material control unit of the above-mentioned invention, the secondary filter layer generating on the cylindrical filter generates as the fixed layer of the powder grain material made in the space in the pores of the inside porous cylinder and the space between the outer periphery of the powder grain material carrying means and the inner porous cylinder, and the quantity of air passage can be adjusted by the quantity of absorbing air in the negative pressure chamber. Besides, the filter cylinder in the shape of a cylinder is not directly contacted with the powder grain material inside the secondary filter layer by the secondary filter layer itself, and blocking does not generate as long as the air passage of the secondary filter layer lasts.

The negative pressure chamber is formed between the inner periphery of the casing which both ends of the cylindrical filter are fixed in a sealed state and the outer periphery of the cylindrical filter. Then, when air is absorbed, the negative pressure chamber is made negative pressure. With this, the air in the cylindrical filter passes through the passage pores so as to enter in the negative pressure chamber. Then, the inner space of the cylindrical filter is also made negative pressure. In the result, the powder grain material is absorbed in the cylindrical filter so as to maintain.

The powder grain material carrying means projects from the powder grain material outflow portion in the discharge direction of the powder grain material a predetermined quantity.

The powder grain material carrying means projects in the discharge direction of the powder grain material and is entered in the powder grain material control unit provided with the powder grain material outflow portion. For this reason, the powder grain material carrying means certainly discharges the powder grain material maintained in the cylindrical filter of the powder grain material control unit.

The above-mentioned powder grain material carrying means operates with low speed at the first and the last stages of the discharge of the powder grain material, and operates with high speed during discharging.

The powder grain material carrying means improves the efficiency of discharging the powder grain material by operating with high speed during the discharge of the powder grain material.

The above-mentioned powder grain material carrying means is the auger having the spiral blade formed at the central axis of the rotation.

The auger carries the powder grain material by the rotation of the spiral blade.

The powder grain material filling unit of the present invention has the powder grain material storing means for storing the powder grain material, and any one of the above-mentioned powder grain material control units for filling the powder grain material storing body with the powder grain material supplied from the powder grain material storing means.

The above-mentioned powder grain material storing body is the vinyl bag formed in such a manner that the intermediate portion of the cylindrical vinyl cylinder supplied, enclosing the powder grain material control unit, is closed by the bag forming means to be closed by heat, and the vinyl cylinder goes down, filling with the powder grain material by the powder grain material control unit, and the upper portion rather than the intermediate portion is closed by the bag forming means.

The powder grain material control unit of the present invention does not stop the discharge of the powder grain material by adhering the parts to each other, but stops the discharge of the powder grain material by making the inside of the cylindrical filter negative pressure, and it makes the powder grain material which is stopped the discharge do the role of the valve for stopping the discharge of the powder grain material thereafter. Then, the following effects are exercised.

The discharge of the powder grain material can be certainly and speedily stopped.

Few vibration and noise generates.

The powder grain material is not held in the valve and there is no non-operable state.

Besides, in the powder grain material control unit of the present invention, it is not necessary to change parts since there is no parts on which wear and tear generates if it is used for a long time.

Furthermore, the powder grain material control unit of the present invention can be made small since there is no member crossing the lower hand of the powder grain material outflow portion.

Besides, when there is no member crossing the lower hand of the powder grain material outflow portion, the powder grain material does not hard blown up in the bag in case where the powder grain material storing body is a bag. Besides, in case of a transparent bag, the filling state in the bag can be easily confirmed from the outside.

Furthermore, if the powder grain material held by the cylindrical filter is discharged by the powder grain material carrying means, the powder grain material can be certainly and speedily stopped when the powder grain material carrying means is stopped.

Besides, if the powder grain material carrying means projects from the powder grain material outflow portion, it enters in the cylindrical filter so as to certainly discharge the powder grain material held in the cylindrical filter.

Furthermore, the discharge efficiency can be improved when the powder grain material carrying means is operated with high speed during the discharge of the powder grain material.

Since the powder grain material filling unit of the present invention has the above-mentioned powder grain material control unit for certainly stopping the discharge of the powder grain material, the quantity of filling is not widely changed and the accuracy of filling can be improved.

The powder grain material filling unit of the present invention can make the minimum size of the bag small by providing the above-mentioned small-sized powder grain material control unit.

Since the powder grain material filling unit of the present invention has no member crossing the lower hand of the powder grain material outflow portion, the powder grain material is not hard blown up in the bag. In case of a transparent bag, the filling state in the bag can be easily confirmed from the outside. Besides, in case where the bag is a vinyl bag, the powder grain material is not hard blown up in the vinyl bag, and the degree of melting and adhering the vinyl to each other can be improved and the vinyl bag can be completely sealed.

Since the powder grain material filling unit of the present invention has the above-mentioned powder grain material control unit having few vibration, the accuracy of measuring a weight measuring means, for measuring the weight of the powder grain material, for instance, can be improved so as to improve the accuracy of filling the powder grain material.

DESCRIPTION OF THE PREFERRED EMBODIMENT

A powder grain material control unit and a powder grain material filling unit providing this unit of the embodiment forms of the present invention will now be explained hereinafter with respect to the accompanying drawings FIG. 1 through FIG. 9.

(Composition of the powder grain material filling unit and the powder grain control unit)

Figure 1:
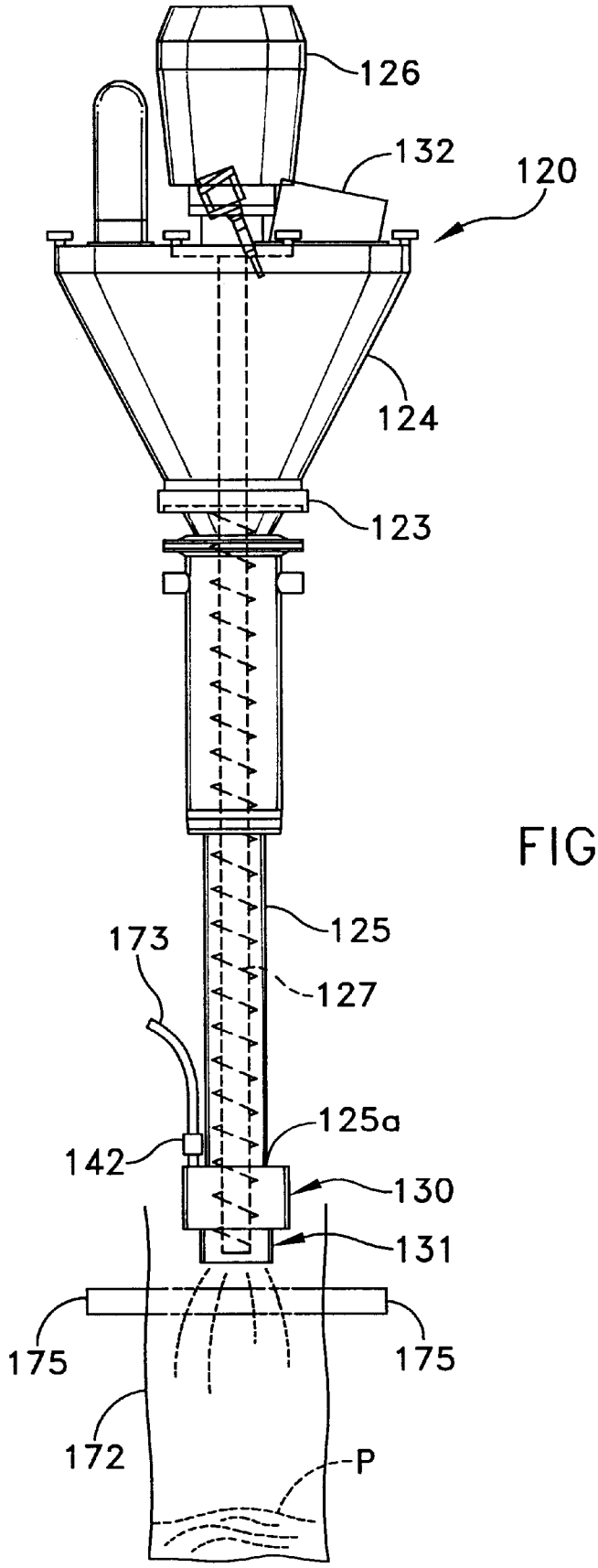
FIG. 1 is a front view of a powder grain material filling unit providing a powder grain material control unit which is one of the embodiment forms of the present invention.
Figure 2:
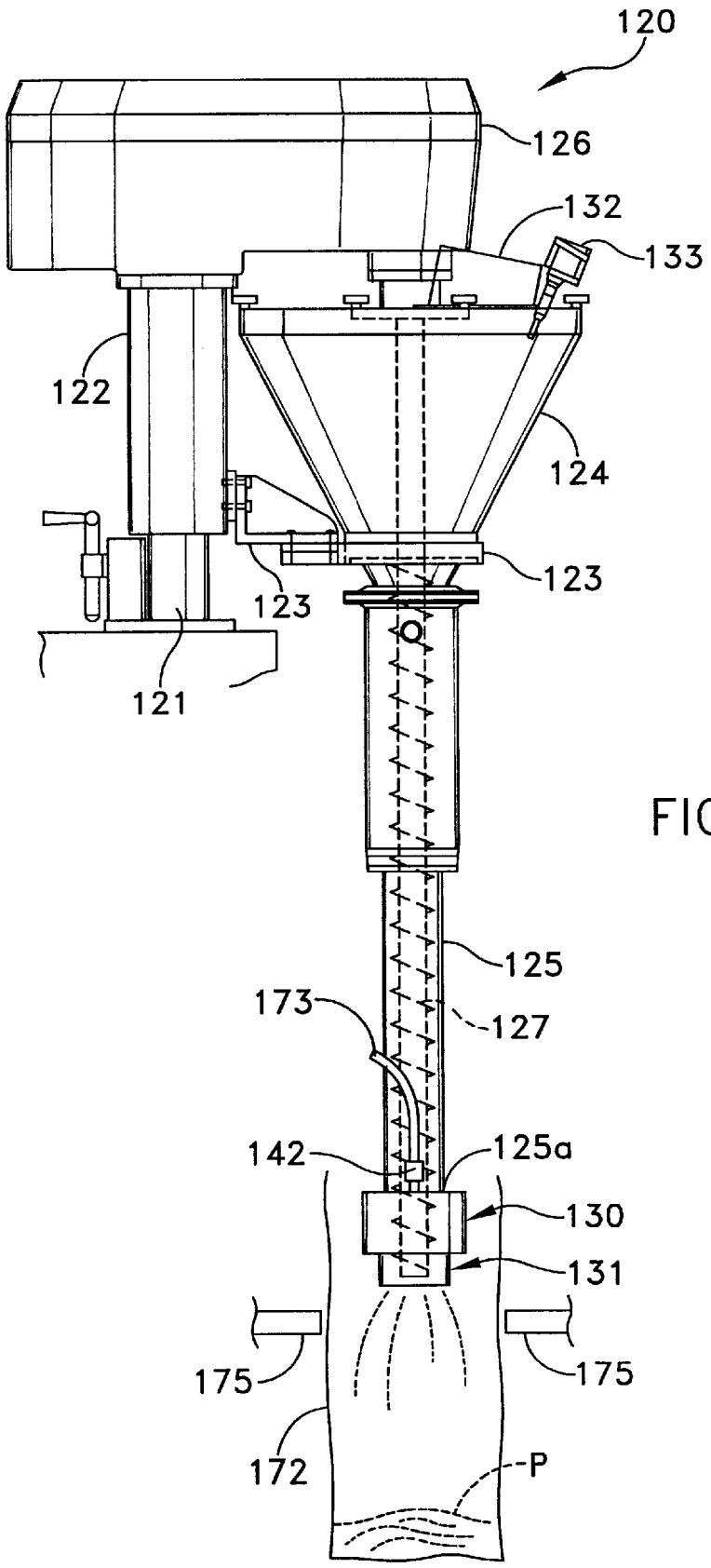
FIG. 2 is a left side view of FIG. 1.
Figure 3:
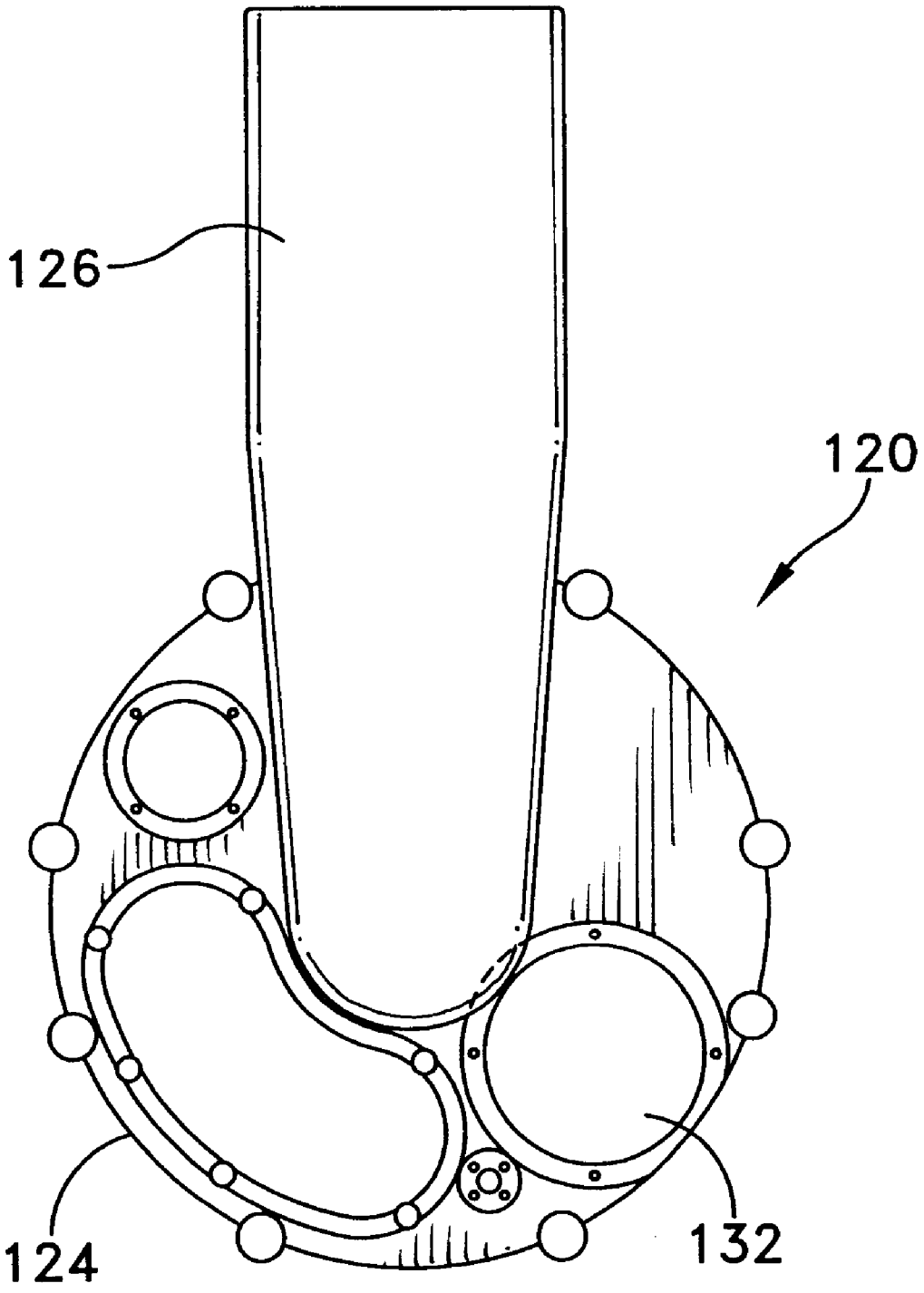
FIG. 3 is a plan view of FIG. 1.

As shown in FIG. 1 through FIG. 3, with a powder grain material filling unit 120, a fixed leg 121, a climbing leg 122 provided with the fixed leg 121 so as to be adjustable in its height position, a hopper 124 in the shape of a cone, for storing powder grain material, provided with a support frame 123 being united with the climbing leg 122, a drop guide shaft 125 for guiding the drop of powder grain material, provided with the lower portion of the hopper 124, a rotatable auger 127 (another name is a screw) stored in the drop guide shaft 125, connected with a driving motor 126 provided with the upper portion of the climbing leg 122, a powder grain material control unit 130 for stopping the discharge of powder grain material from the drop guide shaft 125, attachably and detachably provided with the drop guide shaft 125, and a powder grain material distributing ring 131 screwed down the lower portion of the powder grain material control unit 130, are provided.

On the upper portion of the hopper 124, an opening 132 for throwing powder grain material in, and a detection sensor 133 for detecting storage over of powder grain material in the hopper 124 are provided.

Figure 4:
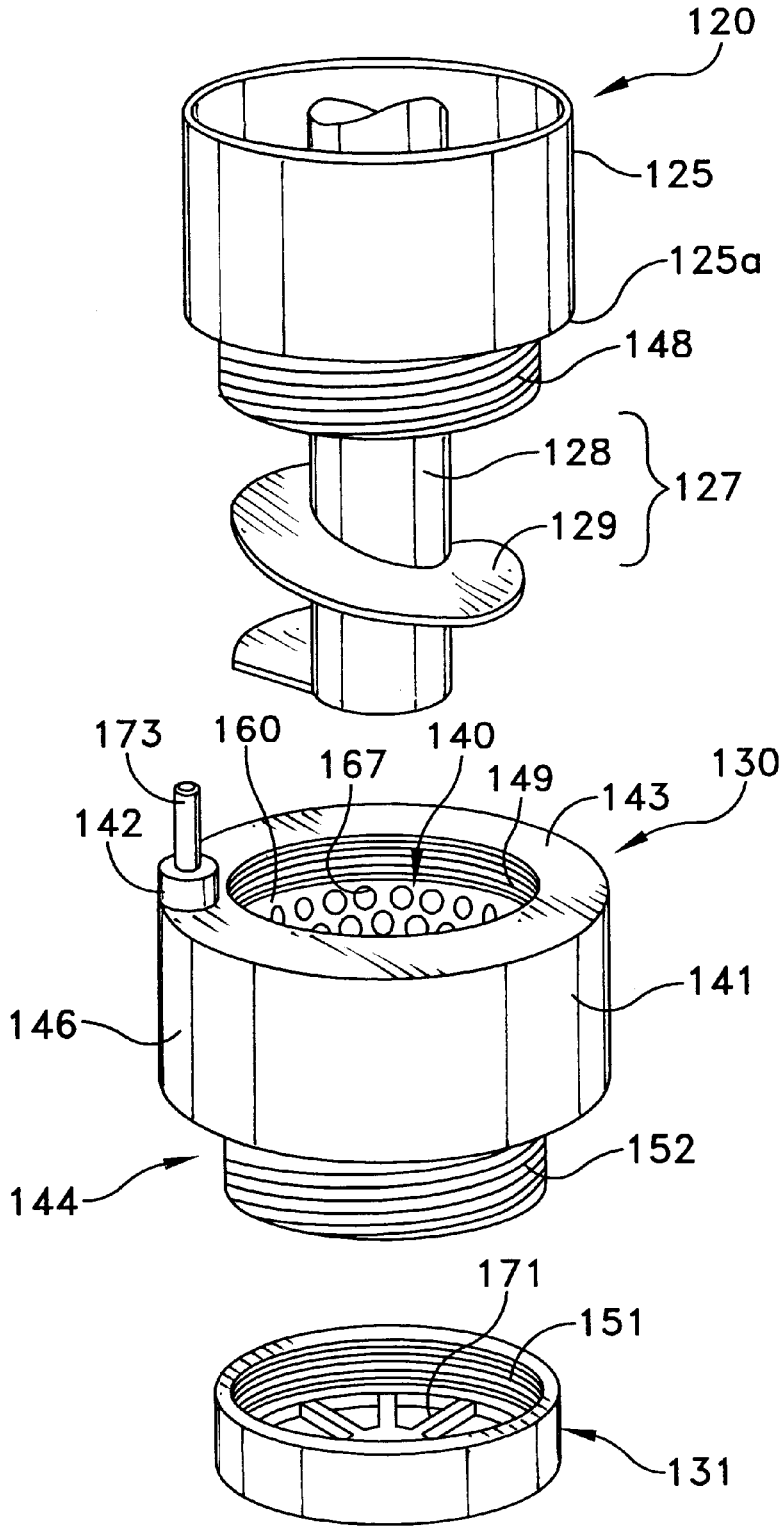
FIG. 4 are a view obliquely seen a powder grain material outflow portion of the powder grain material filling unit and a view obliquely seen a powder grain material control unit disassembled.

As shown in FIG. 4, a spiral blade 129 is provided with a rotation central axis 128 of the auger 127 so as to control the drop of the powder grain material in the drop guide shaft 125.

The powder grain material control unit 130 has a filter layer 140 cylindrically formed, a casing 141 enclosing the outer periphery of the filter layer 140, opening the inner periphery of the filter layer 140, provided with a powder grain material outflow portion 125*a* of the drop guide shaft 125, and a suction cap 142 provided with the upper portion of the casing 141.

Figure 5:
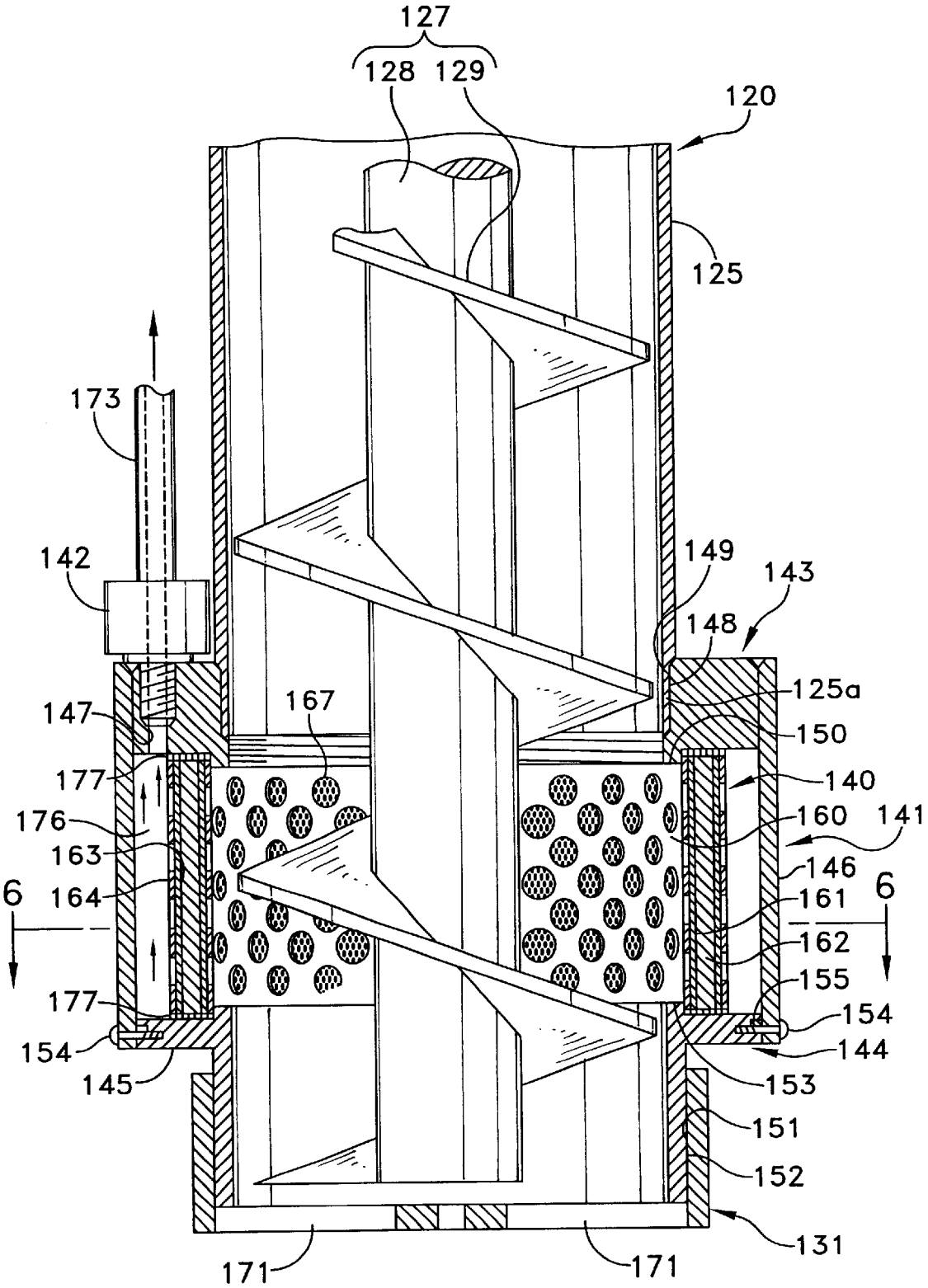
FIG. 5 is a front sectional view showing the powder grain material outflow portion of the powder grain material filling unit and the powder grain material control unit.

As shown in FIG. 5, the casing 141 has an upper flange 143 in the shape of a disc, an lower flange 144 providing a flange 145 with a cylindrical member, and an outside ring 146 uniting both flanges 143 and 144 with each other, in the shape of a cylinder.

The suction cap 142 is screwed on the upper flange 143 so as to form a suction pore 147 communicating with the suction cap 142. A female screw 149 to be screwed on a screw 148 formed on the lower portion of the drop guide shaft 125 is formed on the inner periphery of the upper flange 143. Furthermore, an annular projecting piece 150, engaging with the upper inner periphery of the filter layer 140 is provided with the lower portion of the upper flange 143 so as to project for the lower direction.

A screw 152 to be screwed on a female screw 151 of the powder grain material distributing ring 131 is provided with the lower flange 144. Furthermore, an annular projecting piece 153, engaging with the lower inner periphery of the filter layer 140 is provided with the upper portion of the lower flange 144 so as to project for the upper direction.

The outside ring 146 is united with the upper flange 143 by welding, and is united with the lower flange 144 by a screw 154. The connecting portion between the outside ring 146 and the lower flange 144 has no space by an O-ring 155 installed on the outer periphery of the lower flange 144.

Figure 6:
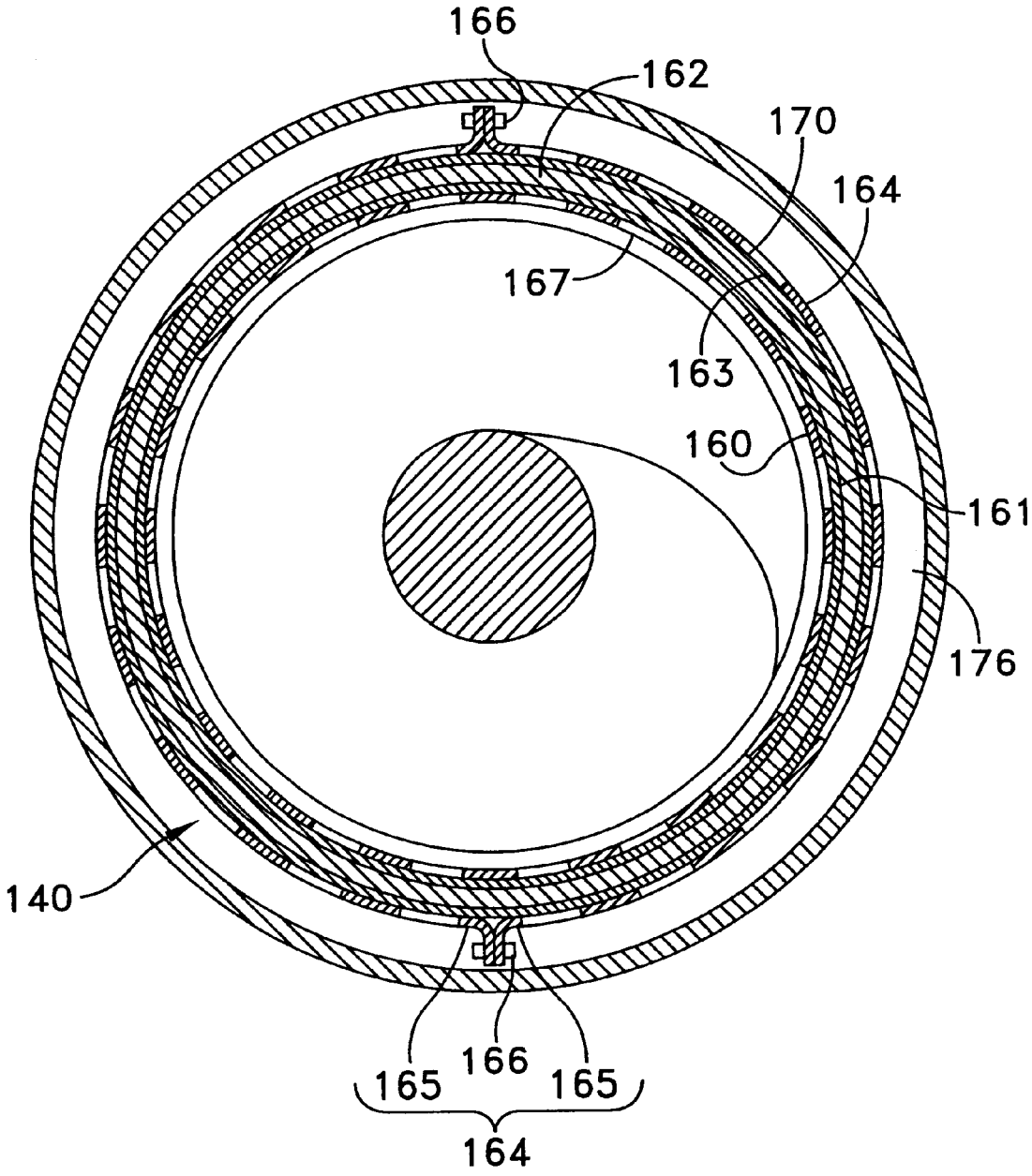
FIG. 6 is a sectional view seen from arrows 6—6 in FIG. 5.
Figure 7:
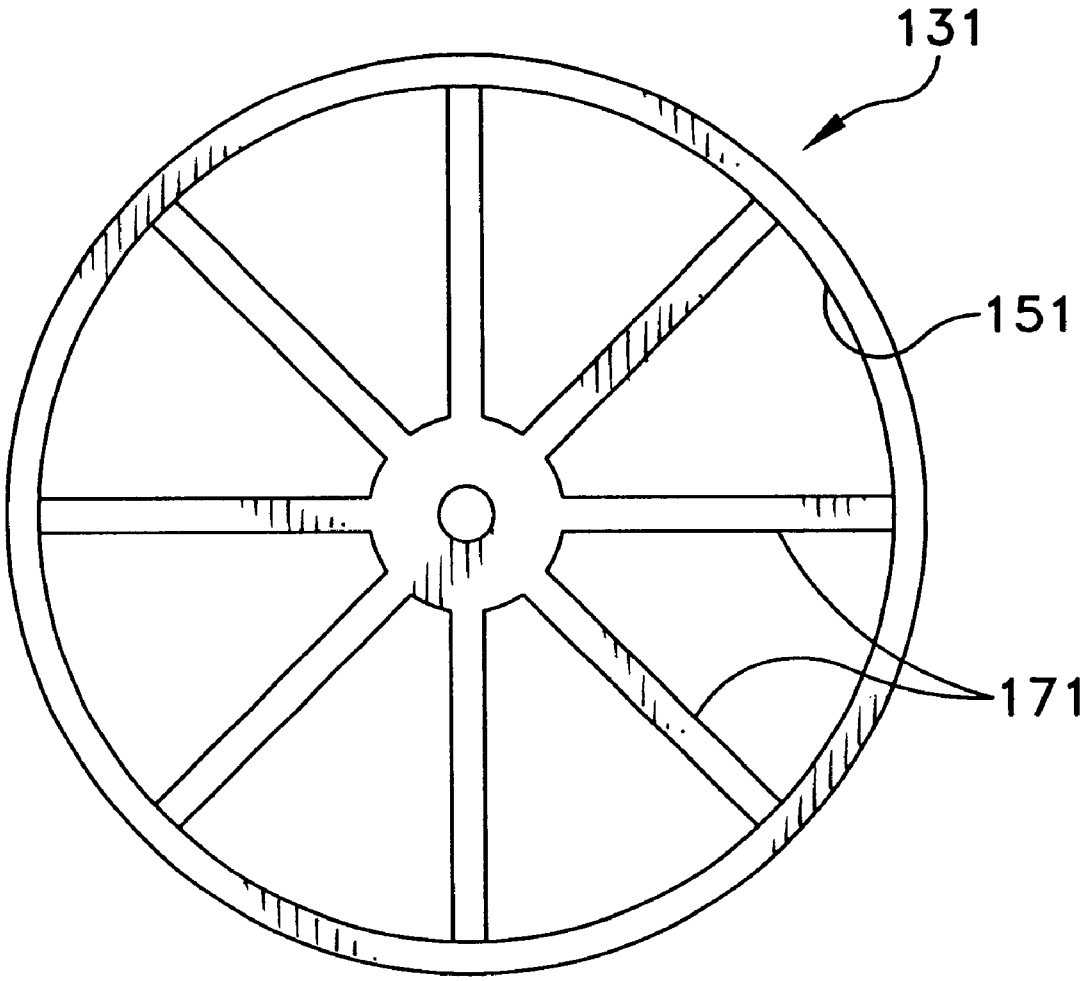
FIG. 7 is a plan view of a powder grain material distributing ring.

As shown in FIG. 6, with the filter layer 140, an inside porous cylinder 160 in the shape of a cylinder, an inside gauze cylinder 161, a filter cylinder 162, and an outside gauze cylinder 163 are provided, layering in order from the inside, and an outside porous cylinder 164 is provided with the outermost side thereof. The outside porous cylinder 164 tight binds the whole filter layer 140 by tight binding the end portions of porous cylinder pieces 165, 165 divided in two in the shape of a semicircle by a bolt 166. Besides, the inside porous cylinder 160 and the outside porous cylinder 164 prevents the deformation of the filter cylinder 162 through the inside gauze cylinder 161 and the outside gauze cylinder 163, and many pores 167, 170 are formed. These pores 167 and 170 are formed at the position corresponding with each other so as to pass air through. The occupied area of the respective pores 167, 170 is about half of the outer peripheral area of the outside porous cylinder 164 or the inner peripheral area of the inside porous cylinder 160. Besides, the air in powder grain material can be sucked into the pore 167 through a secondary filter layer described hereinafter. On this occasion, the gauze cylinder may be a gauze cylinder made of resin as well as metal.

The filter of the filter cylinder 162 having various kinds of structures can be used. But, in case where the grain size of the powder grain material is 5 micron or so, the finer mesh filter, for instance, the mesh filter having the size of 0.5 micron or so is preferable. As this filter, sintered type filter material molding and sintering metallic or non-metallic fiber or ceramic powder body, for instance, is used in view of filter accuracy and manufacturing accuracy. Besides, the inside gauze cylinder 161 and the outside gauze cylinder 163 reinforce the filter cylinder 162, and are protecting layers for providing blocking of these surface.

In the powder grain control unit 130, the upper and lower flanges 143, 144 and the outside ring 146 are united one another in such a manner that the filter layer 140 is installed on the annular projecting pieces 150, 153 of the upper and lower flanges 143, 144, thereafter the outside ring 146 is installed on the upper and lower flanges 143, 144 so as to weld the upper flange 143 and the outside ring 146, the lower flange 144 and the outside ring 146 are fastened by the screw 154. Between the upper and lower flanges 143, 144 and the lower and upper ends of the filter layer 140, gauze cylinders 177, 177 in the shape of a donut exist, and the upper and the lower ends of the filter layer 140 are sealed.

With the powder grain material distributing ring 131, the female screw 151 to be screwed on the screw 152 formed at the lower portion of the powder grain material control unit 130 and a plurality of radial bars 171 are provided.

(Operation of the powder grain material filling unit and the powder grain material control unit)

The powder grain material control unit 130 is attached to the drop guide shaft 125 by screwing the female screw 149 of the upper flange 143 on the lower screw 148 of the drop guide shaft 125.

As shown in FIG. 2, a bag 172 is stood by at the lower portion of the drop guide shaft 125, the powder grain material is entered from the opening 132 of the hopper 124, the driving motor 126 is started to drive, and the auger 127 is rotated so as to drop the powder grain material in the drop guide shaft 125 from the hopper 124 by its dead weight and the rotation of the auger 127. Thereafter, the auger 127 is stopped.

Figure 8:
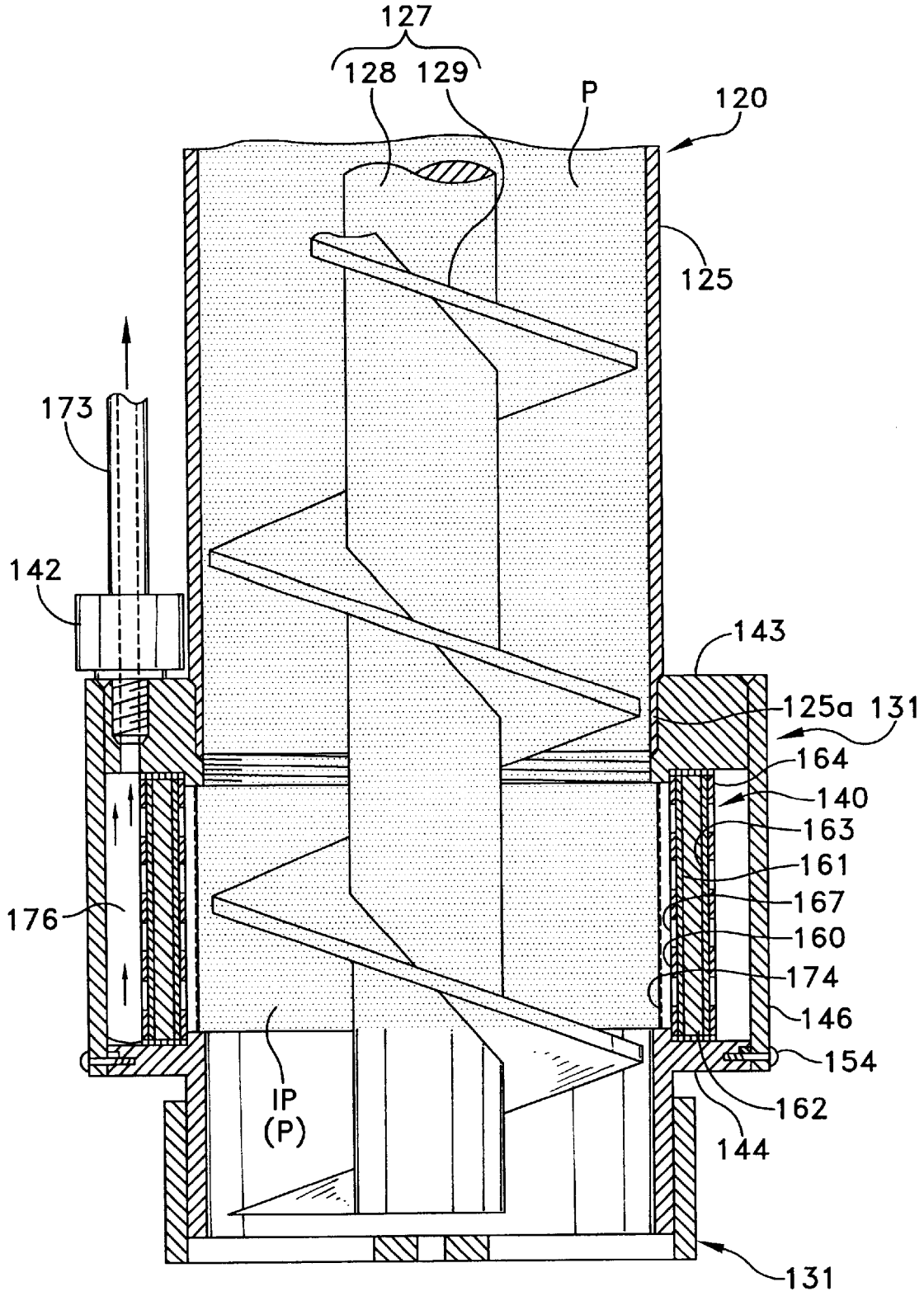
FIG. 8 is a front sectional view showing the powder grain material control unit in such a state that powder grain material is discharged and the powder grain material outflow portion of the powder grain material filling unit.

And, when the air in a negative pressure chamber 176 between the outer periphery of the filter layer 140 and the inner periphery of the casing 141 is sucked by a pipe 173 connected with the suction cap 142, the air of the inner peripheral portion IP side of the filter layer 140 in the state of being filled with the powder grain material, as shown in FIG. 8 is sucked, passing through the respective pores 167, 170 of the inside porous cylinder 160 and the outside porous cylinder 164, the inside gauze cylinder 161, the outside gauze cylinder 163 and the filter cylinder 162.

On this occasion, the powder grain material at the position adjacent to the inner peripheral face of the filter layer 140 of the powder grain material of the inner peripheral portion IP side of the filter layer 140 is absorbed on the inner wall of the filter layer 140, and is fastened and hardened, as shown in FIG. 8 so as to form a secondary filter layer 174 having a predetermined thickness by the powder grain material in the shape of a cylinder. This secondary filter layer 174 is the fixed layer of the powder grain material made in the space in the pore 167 of the inside porous cylinder 160 and the space between the outer periphery of the blade 129 and the inside porous cylinder 160, and its air passing quantity is adjustable by the air absorbing quantity in the negative pressure chamber 176. Besides, the filter layer 140 is not directly contacted with the powder grain material inside the secondary filter layer 174 by forming the secondary filter layer 174 in the state of being fastened and hardened, and is not blocked as long as air continues to pass through the secondary filter layer 174. That is, the secondary filter layer 174 is not the layer made by blocking the filter cylinder 162, but when the powder grain material inside the secondary filter layer 174 is absorbed in the filter layer 140 side, the secondary filter layer 174 fastened and hardened at relatively high density prevents the particle of the powder grain material from reaching the filter layer 140 so as to save blocking the filter cylinder 162 and so as to improve air absorbing efficiency.

In this state, the powder grain material P of the inner peripheral side of the filter layer 140 is maintained in the state of being fastened on the inner peripheral portion IP side of the filter layer 140 and in the state of high bulk density by absorbing air so as to stop the outflow on the lower hand.

That is, the powder grain material is stopped discharging, and stops further discharging the powder grain material by serving as a valve for stopping the flow of the powder grain material by the powder grain material itself.

In order to discharge the powder grain material, the auger 127 is rotated so as to compulsorily discharge the powder grain material filled inside the filter layer 140. When the rotation of the auger 127 is stopped after a predetermined quantity of the powder grain material drops in the vinyl bag 172, the powder grain material is not discharged while being absorbed and maintained for the inner periphery side of the filter layer 140.

In order to quickly discharge the powder grain material and correctly discharge it a predetermined quantity in the vinyl bag, almost 90 percent of the predetermined quantity of the powder grain material may be discharged after starting the auger 127 by making its rotation quickly, and then the remaining almost 10 percent may be discharged by slowly rotating.

Besides, the powder grain body may be easily discharged in such a manner that the inside of the filter layer 140 is made a predetermined negative pressure when the flow of the powder grain material is stopped and is made atmospheric pressure or negative pressure near to the atmospheric pressure rather than a predetermined negative pressure at the time of stopping the discharge of the powder grain material when the powder grain body is flowed so as to help the discharge by the auger 127.

Such a fear that the powder grain material drops in the vinyl bag 172 in a being hardened state since it is exhausted in a pressed and bulky state by the powder grain material control unit 130 when it drops in the vinyl bag 172 may be entertained. But, the powder grain material equally drops in the vinyl bag without being blown up in a powder state since it is dispersed as an appropriate sized lump by the bars 171 of the powder grain material distributing ring 131 provided with the lower portion of the powder grain material control unit 130.

When the powder grain material drops in the vinyl bag a predetermined quantity, the vinyl bag 172 is closed by a heated bag closing piece 175, as shown in FIG. 2.

The vinyl bag is formed in such a manner that the intermediate portion of the vinyl cylinder in the shape of a cylinder supplied from the upper hand, enclosing the powder grain material control unit, is closed by the bag closing piece 175, the vinyl cylinder goes down, being filled with the powder grain material by the powder grain material control unit, and the upper portion rather than the intermediate portion is closed again by the bag closing piece 175.

The filter cylinder 162 can be changed by detaching the screw 154 of the lower flange 144 and pulling the lower flange 144 and the filter layer 140 out of the upper flange 143 and the outside ring 146.

Besides, the choking of the filter may be solved by entering highly pressured air from the suction cap 142, and its maintenance is easy.

Figure 9:
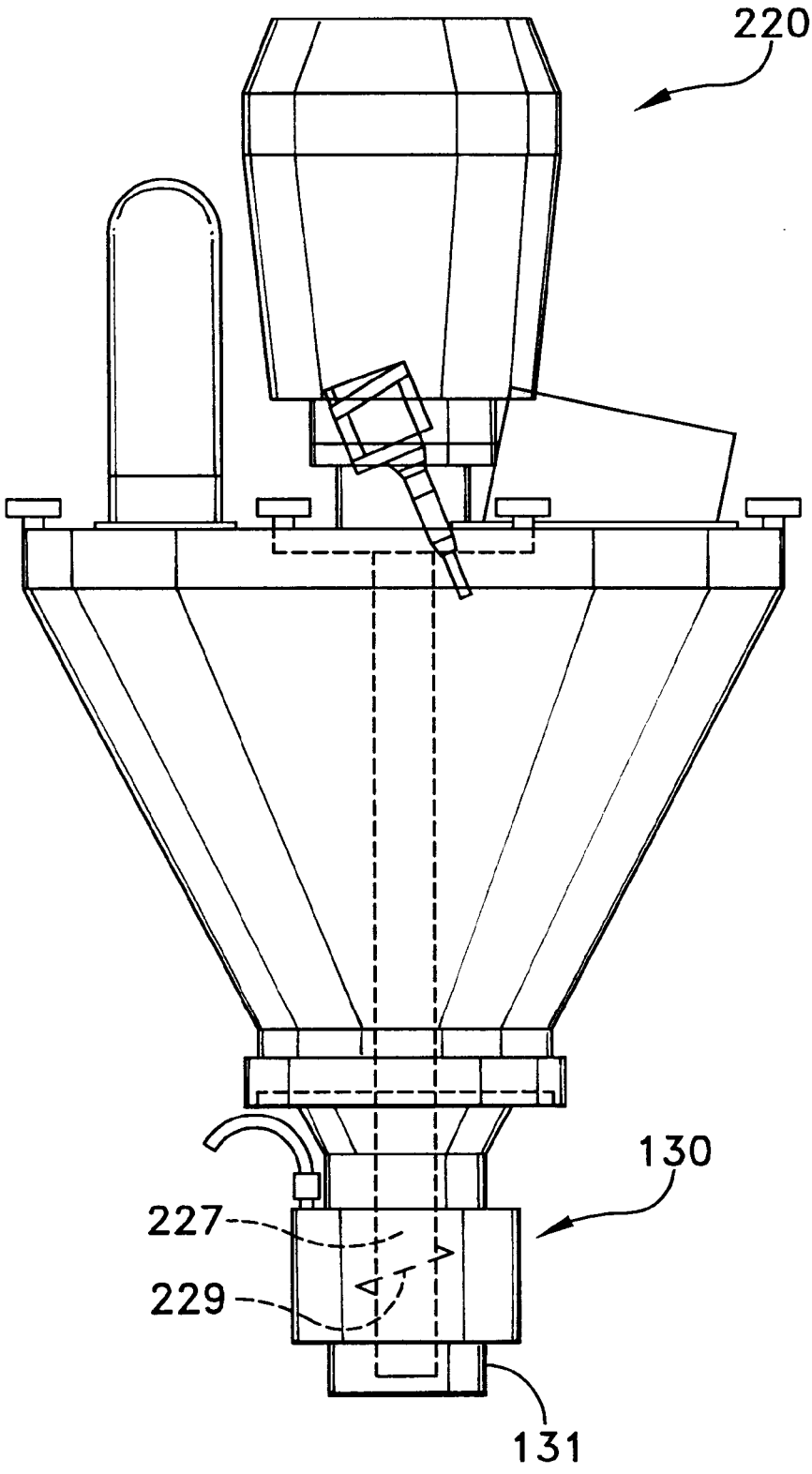
FIG. 9 is a front view showing the powder grain material filling unit of another embodiment form.
Figure 10:
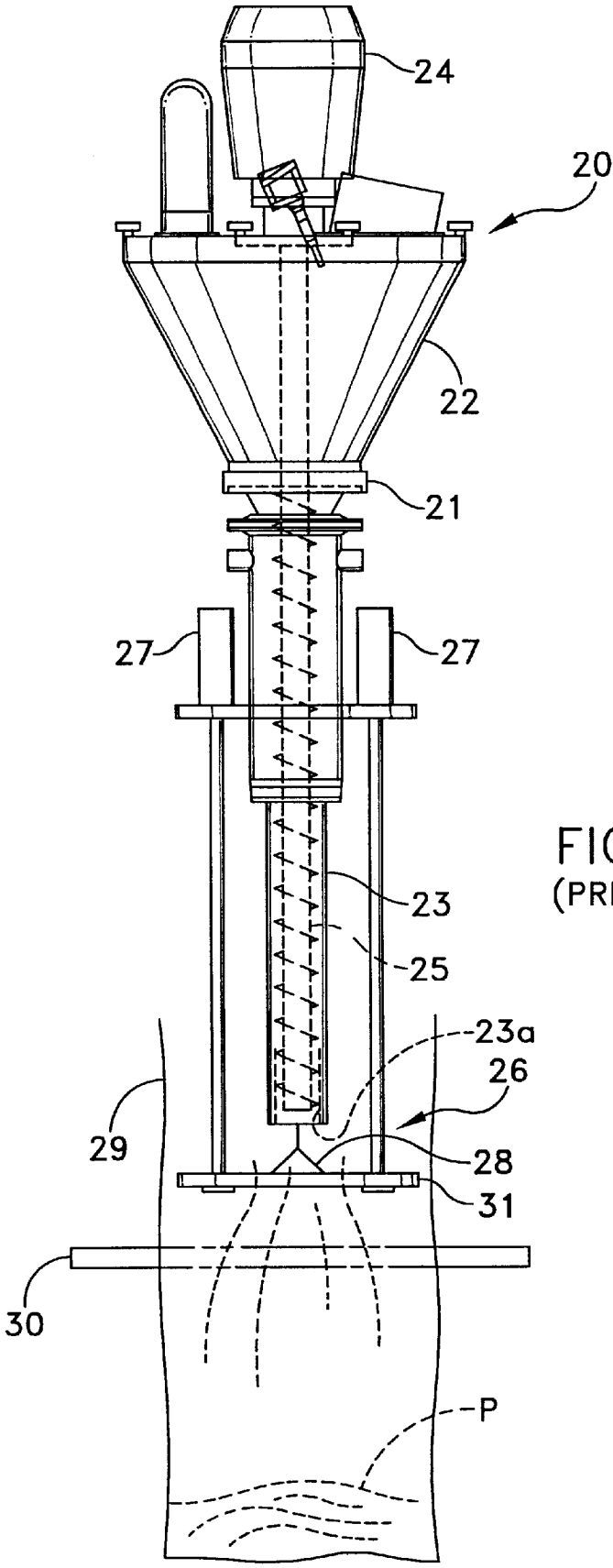
FIG. 10 (PRIOR ART)
FIG. 10 is a front view showing the powder grain material filling unit providing a conventional powder grain material control unit.

Furthermore, the above-mentioned powder grain material filling unit 120 has the drop guide cylinder 125 and the auger 127 having almost the same length as one of this drop guide cylinder 125. But, as a powder grain material filling unit 220 as shown in FIG. 9, the drop guide cylinder may be omitted, the length of an auger 227 may be made short and a roll of a blade 229 having spiral shape may be formed.

Besides, it is not always necessary to enter the lower end of the augers 127, 227 of the powder grain material filling units 120, 220 in the above-mentioned two embodiments in the powder grain material control unit 130 although in fact, the end is entered in. The length of the augers 127, 227 may be the length to almost the upper end of the powder grain material control unit 130.

When it is not necessary to fill with so correct quantity, the augers 127, 227 are not always necessary. In this case, in order to stop the discharge of the powder grain material, air is sucked so as to make the inner peripheral side of the filter layer 140 more negative pressure than predetermined, and then, the powder grain material is absorbed in the inner peripheral side of the filter layer 140 so as to prevent the discharge. In order to discharge, the suction of air is stopped so as to return the pressure of the inner peripheral side of the filter layer to an atmospheric pressure, or so as to make the negative pressure to such a degree that the powder grain material discharges. Then, the powder grain material is dropped and discharged by its dead weight.

Accordingly, the above-mentioned powder grain material control unit 120 does not stop the discharge of the powder grain material by closely contacting the parts with each other, but by making the inner peripheral side of the filter layer 140 negative pressure. Besides, the powder grain material can be correctly and speedily stopped since the discharge of the powder grain material is stopped by making the inner peripheral side of the filter layer 140 negative pressure and by getting the powder grain material which is stopped to discharge act as a valve to stop the discharge of the powder grain material thereafter without no mechanical operation.

The embodiments which are described in the present specification are illustrative and not limiting. The scope of the invention is designated by the accompanying claims and is not restricted by the descriptions of the specific embodiments. Accordingly, all the transformations and changes belonging to the claims are included in the scope of the present invention.

What is claimed is:

1. A powder grain material control unit, comprising:

a cylindrical filter cylindrically formed;

a negative pressure chamber formed at an outer periphery of said cylindrical filter;

means for generating negative pressure connected with said negative pressure chamber; and said cylindrical filter having a filter cylinder in the shape of a cylinder and an inside porous cylinder and an outside porous cylinder in the shape of a cylinder respectively holding an inner periphery and an outer periphery of said filter cylinder through gauze cylinders in the shape of a cylinder, and many air passing pores through which air passes being formed at said inside porous cylinder and said outside porous cylinder;

wherein said cylindrical filter and said negative pressure chamber are attached to a powder grain material outflow portion from which a powder grain material is discharged, air in said negative pressure chamber is absorbed by said means for generating negative pressure, an inner peripheral portion side of said cylindrical filter is negatively pressurized so as to stop the discharge of said powder grain material in the inner peripheral portion of said cylindrical filter.

2. The powder grain material control unit as set forth in claim 1, wherein said powder grain material outflow portion faces downwardly, and by driving said means for generating negative pressure, the flow of said powder grain material flowing in the inner peripheral portion of said cylindrical filter is stopped by increasing the negative pressure on the inner peripheral portion side of said cylindrical filter and the powder grain material inside said cylindrical filter is discharged by decreasing the negative pressure to a predetermined negative pressure.

3. The powder grain material control unit as set forth in claim 1, wherein a guide cylinder for guiding said powder grain material is provided having a powder grain material carrying means for pushing said powder grain material out provided within said guide cylinder and a top end of said guide cylinder being provided with said powder grain material outflow portion such that said powder grain material is discharged by an operation of said powder grain material carrying means in such a state that the inner peripheral portion side of said cylindrical filter is negatively pressurized, and the discharge of said powder grain material is stopped by stopping the operation of said powder grain material carrying means.

4. The powder grain material control unit as set forth in claim 3, wherein said powder grain material carrying means projects from said powder grain material outflow portion in a discharge direction of said powder grain material a predetermined quantity.

5. The powder grain material control unit as set forth in claim 3, wherein said powder grain material carrying means operates at a low speed at first and last stages of discharging said powder grain material and operates at high speed during discharging.

6. The powder grain material control unit as set forth in claim 3, wherein said powder grain material carrying means is an auger having a spiral blade provided with a central axis of rotation.

7. A powder grain material control unit, comprising:

a cylindrical filter cylindrically formed;

a negative pressure chamber formed at an outer periphery of said cylindrical filter;

means for generating negative pressure connected with said negative pressure chamber;

said negative pressure chamber being formed between an inner periphery of a casing and an outer periphery of said cylindrical filter; and both ends of said cylindrical filter being fixed in a sealed state by said casing;

wherein said cylindrical filter and said negative pressure chamber are attached to a powder grain material outflow portion from which a powder grain material is discharged, air in said negative pressure chamber is absorbed by said means for generating negative pressure, an inner peripheral portion side of said cylindrical filter is negatively pressurized so as to stop the discharge of said powder grain material flowing in the inner peripheral portion of said cylindrical filter.

8. The powder grain material control unit as set forth in claim 7, wherein said powder grain material outflow portion faces downwardly, and by driving said means for generating negative pressure, the flow of said powder grain material flowing in the inner peripheral portion of said cylindrical filter is stopped by increasing the negative pressure on the inner peripheral portion side of said cylindrical filter and the powder grain material inside said cylindrical filter is discharged by decreasing the negative pressure to a predetermined negative pressure.

9. The powder grain material control unit as set forth in claim 7, wherein a guide cylinder for guiding said powder grain material is provided having a powder grain material carrying means for pushing said powder grain material out provided within said guide cylinder and a top end of said guide cylinder being provided with said powder grain material outflow portion such that said powder grain material is discharged by an operation of said powder grain material carrying means in such a state that the inner peripheral portion side of said cylindrical filter is negatively pressurized, and the discharge of said powder grain material is stopped by stopping the operation of said powder grain material carrying means.

10. The powder grain material control unit as set forth in claim 9, wherein said powder grain material carrying means projects from said powder grain material outflow portion in a discharge direction of said powder grain material a predetermined quantity.

11. The powder grain material control unit as set forth in claim 9, wherein said powder grain material carrying means operates at a low speed at a first and a last stage of discharging said powder grain material and operates at a high speed during discharging.

12. The powder grain material control unit as set forth in claim 9, wherein said powder grain material carrying means is an auger having a spiral blade provided with a central axis of rotation.

13. A powder grain material filling unit, comprising:

a powder grain material storing means for storing a powder grain material;

a powder grain material control unit for filling a powder grain material storing body with said powder grain material supplied from said powder grain material storing means, said powder grain material control unit having a cylindrical filter cylindrically formed, and a negative pressure chamber formed at an outer periphery of said cylindrical filter, and a means for generating negative pressure connected with said negative pressure chamber; and said cylindrical filter having a filter cylinder in the shape of a cylinder and an inside porous cylinder and an outside porous cylinder in the shape of a cylinder respectively holding an inner periphery and an outer periphery of said filter cylinder through gauze cylinders in the shape of a cylinder, and many air passing pores through which air passes are formed at said inside porous cylinder and said outside porous cylinder;

wherein said cylindrical filter and said negative pressure chamber are attached to a powder grain material outflow portion from which a powder grain material is discharged, air in said negative pressure chamber is absorbed by said means for generating negative pressure, the inner peripheral portion side of said cylindrical filter is negatively pressurized so as to stop the discharge of said powder grain material flowing in the inner peripheral portion of said cylindrical filter.

14. The powder grain material filling unit as set forth in claim 13, wherein said powder grain material storing body is a vinyl bag formed in such a manner that a vinyl cylinder in the shape of a cylinder is supplied, enclosing said powder grain material control unit, an intermediate portion of said vinyl cylinder is closed by a bag forming means by heat, said vinyl cylinder goes down, filling with said powder grain material by said powder grain material control unit, and an upper hand rather than said intermediate portion is closed by said bag forming means.

15. A powder grain material filling unit, comprising:

a powder grain material storing means for storing a powder grain material;

a powder grain material control unit for filling a powder grain material storing body with said powder grain material supplied from said powder grain material storing means, said powder grain material control unit having a cylindrical filter cylindrically formed, and a negative pressure chamber formed at an outer periphery of said cylindrical filter, and a means for generating negative pressure connected with said negative pressure chamber;

said negative pressure chamber being formed between the inner periphery of a casing and the outer periphery of said cylindrical filter; and both ends of said cylindrical filter being fixed in a sealed state by said casing;

wherein said cylindrical filter and said negative pressure chamber are attached to a powder grain material outflow portion from which a powder grain material is discharged, air in said negative pressure chamber is absorbed by said means for generating negative pressure, the inner peripheral portion side of said cylindrical filter is negatively pressurized so as to stop the discharge of said powder grain material flowing in the inner peripheral portion of said cylindrical filter.

16. The powder grain material filling unit as set forth in claim 15, wherein said powder grain material storing body is a vinyl bag formed in such a manner that a vinyl cylinder having the shape of a cylinder is supplied, enclosing said powder grain material control unit, an intermediate portion of said vinyl cylinder is closed by a bag forming means by heating, said vinyl cylinder goes down, filing with said powder grain material by said powder grain material control unit, and an upper hand rather than said intermediate portion is closed by said bag forming means.

17. A powder grain material control unit for attachment to a powder grain material outflow portion of a powder grain material filling unit, the control unit comprising:

a cylindrically formed filter; and a negative pressure chamber formed at an outer periphery of said cylindrical filter, a means for generating negative pressure connected with said negative pressure chamber; and said cylindrical filter having a filter cylinder in the shape of a cylinder and an inside porous cylinder and an outside porous cylinder in the shape of a cylinder respectively holding an inner periphery and an outer periphery of said filter cylinder through gauze cylinders in the shape of a cylinder, and many air passing pores through which air passes are formed at said inside porous cylinder and said outside porous cylinder;

wherein said cylindrical filter and said negative pressure chamber are attached to said powder grain material outflow portion and said cylindrical filter can be negatively pressurized by means for generating negative pressure to stop the discharge of said powder grain material flowing in the inner peripheral portion of said cylindrical filter.

18. A powder grain material control unit for attachment to a powder grain material outflow portion of a powder grain material filling unit, the control unit comprising:

a cylindrically formed filter; and a negative pressure chamber formed at an outer periphery of said cylindrical filter, a means for generating negative pressure connected with said negative pressure chamber;

said negative pressure chamber being formed between the inner periphery of a casing and the outer periphery of said cylindrical filter; and both ends of said cylindrical filter being fixed in a sealed state by said casing;

wherein said cylindrical filter and said negative pressure chamber are attached to said powder grain material outflow portion and said cylindrical filter can be negatively pressurized by said means for generating negative pressure to stop the discharge of said powder grain material flowing in the inner peripheral portion of said cylindrical filter.

* * * * *